US010369816B2

(12) United States Patent
Seki et al.

(10) Patent No.: US 10,369,816 B2
(45) Date of Patent: Aug. 6, 2019

(54) SHEET PROCESSING DEVICE, AND SHEET MANUFACTURING APPARATUS

(71) Applicant: SEIKO EPSON CORPORATION, Tokyo (JP)

(72) Inventors: Shunichi Seki, Suwa (JP); Hiroki Kurata, Matsumoto (JP); Shinichi Kato, Matsumoto (JP); Kaneo Yoda, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/117,299

(22) Filed: Aug. 30, 2018

(65) Prior Publication Data

US 2019/0061389 A1 Feb. 28, 2019

(30) Foreign Application Priority Data

Aug. 31, 2017 (JP) ..... 2017-166555

(51) Int. Cl.
*B41J 13/00* (2006.01)
*B41J 11/00* (2006.01)

(52) U.S. Cl.
CPC ..... *B41J 13/0009* (2013.01); *B41J 11/0015* (2013.01)

(58) Field of Classification Search
CPC ..... B41J 13/009; B41J 11/0015
See application file for complete search history.

(56) References Cited

U.S. PATENT DOCUMENTS

2004/0066441 A1* 4/2004 Jones ..... B41J 3/60 347/101

FOREIGN PATENT DOCUMENTS

JP H05-011664 A 1/1993
JP 2001-279589 A 10/2001

OTHER PUBLICATIONS

IP.com search (Year: 2019).*

* cited by examiner

*Primary Examiner* — Lisa Solomon
(74) *Attorney, Agent, or Firm* — Oliff PLC

(57) ABSTRACT

Provided is technology enabling reliably erasing information on recovered paper, and whitening (reducing blackening) of the sheet. A sheet processing device has an image inspector configured to determine from a sheet printed with image information at least one of a background color of the sheet, and position, size, and color of the image information on the sheet; an image analyzer configured to determine, based on the evaluation result from the image inspector, a type of ink masking agent and an amount of ink masking agent; an ink masking agent applicator configured to apply to the image information printed on the sheet an ink masking agent of the specific type and specific amount determined by the image analyzer; and a shredder configured to comminute the sheet to which the ink masking agent was applied by the ink masking agent applicator.

4 Claims, 9 Drawing Sheets

| | IMAGE INFORMATION | INK MASKING AGENT TYPE |
|---|---|---|
| 1 | WATER BASED INK | WATER BASED INK |
| 2 | RESIN TONER | SOLVENT INK (OR OIL BASED INK) |

FIG. 5

SHEET PROCESSING DEVICE, AND SHEET MANUFACTURING APPARATUS

BACKGROUND

1. Technical Field

The present invention relates to a sheet processing device, and a sheet manufacturing apparatus.

2. Related Art

JP-A-2001-279589 describes a wet-process deinked pulp manufacturing method that uses chemicals to separate ink from pulp.

JP-A-H5-11664 describes a paper erasing machine that recycles recovered paper by developing only the printed portions of the recovered paper with a white toner.

However, the wet-process deinked pulp manufacturing method described in JP-A-2001-279589 uses a large amount of chemicals and process water, and therefore requires a large system.

The paper erasing machine described in JP-A-2001-279589 creates areas that when printed may be difficult to see and read.

There is therefore a need for a sheet processing device and sheet manufacturing apparatus scaled for use in a business office that can completely obliterate information on recovered paper and whiten (reduce blackening) sheets manufactured from the recovered paper.

SUMMARY

The present invention is directed to solving at least part of the foregoing problem, and can be achieved by the embodiments or examples described below.

Example 1

A sheet processing device including: an image inspector configured to determine from a sheet printed with image information at least one of a background color of the sheet, and position, size, and color of the image information on the sheet; an image analyzer configured to determine, based on the evaluation result (identification result) of the image inspector, a type of ink masking agent and an amount of ink masking agent; an ink masking agent applicator configured to apply to the image information printed on the sheet an ink masking agent of the specific type and specific amount determined by the image analyzer; and a shredder configured to comminute the sheet to which the ink masking agent was applied by the ink masking agent applicator.

This configuration applies an appropriate ink masking agent (a specific type of ink masking agent and specific amount of ink masking agent) to a sheet with an ink masking agent applicator based on the result of an image inspector evaluating image information on a sheet. After the ink masking agent is applied, the sheet is then shredded and defibrated. As a result, image information (such as confidential information) on a sheet can be completely erased without requiring large scale equipment. In addition, whiteness can be imparted to the newly manufactured sheet.

Example 2

In this sheet processing device, the ink masking agent is preferably ink.

Because ink easily bleeds into the sheet, when the ink is applied to a sheet, the ink penetrates deeply into the sheet and bleeds into the part of the image that has penetrated into the sheet. Because the sheet is then shredded and defibrated, ink, toner, and other color material can be reliably masked.

Example 3

Further preferably, the ink is white ink.

This configuration applies white ink to the sheet regardless of the background color of the sheet. As a result, whiteness can be imparted even if recycled sheets are produced multiple times from the same feedstock.

Example 4

Another aspect of the invention is a sheet manufacturing apparatus including the sheet processing device described above.

This configuration applies an appropriate ink masking agent (a specific type of ink masking agent and specific amount of ink masking agent) to a sheet with an ink masking agent applicator based on the result of an image inspector evaluating image information on a sheet. After the ink masking agent is applied, the sheet is then shredded and defibrated, and a new sheet is made using the defibrated feedstock. As a result, image information on a sheet can be completely erased without requiring large scale equipment, and whiteness can be imparted to the newly manufactured sheet.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 5 is a flow chart of the sheet processing method of the sheet processing device according to the first embodiment of the invention.

DESCRIPTION OF EMBODIMENTS

Preferred embodiments of the invention are described below with reference to the accompanying figures. Note that the embodiments described below do not unduly limit the scope of the invention described in the accompanying claims. All configurations described below are also not necessarily essential elements of the invention.

Embodiment 1

A sheet manufacturing apparatus including a sheet processing device according to this embodiment of the invention is described first.

Figure 1:
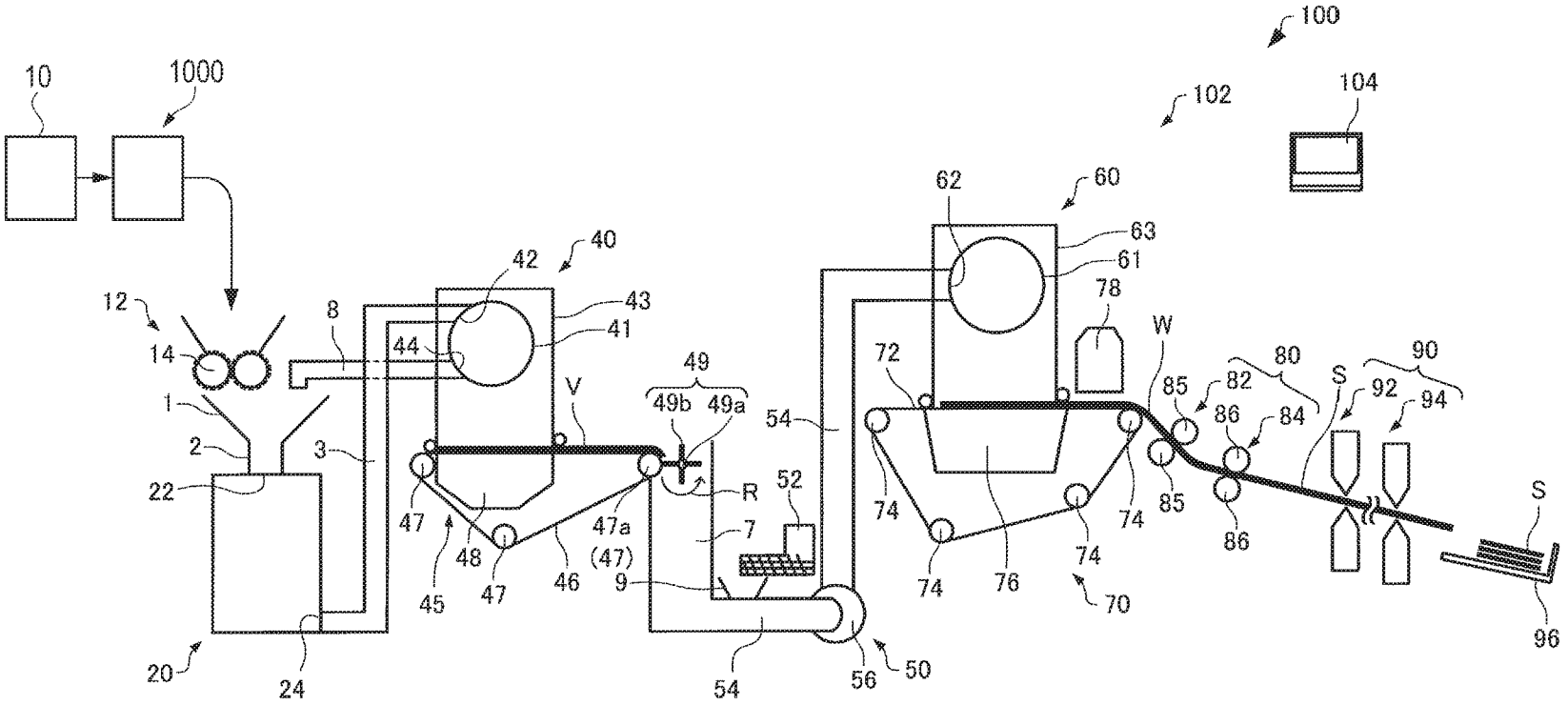
FIG. 1 schematically illustrates the configuration of s sheet manufacturing apparatus according to a first embodiment of the invention.

FIG. 1 schematically illustrates the configuration of s sheet manufacturing apparatus according to a first embodiment of the invention.

As shown in FIG. 1, the sheet manufacturing apparatus 100 includes a supply device 10, manufacturing device 102, and controller 104. The manufacturing device 102 manufactures sheets S. The manufacturing device 102 includes a shredder 12, defibrator 20, classifier 40, first web forming device 45, rotor 49, mixing device 50, air-laying device 60, second web forming device 70, sheet forming device 80, and cutting device 90, and discharge device 96.

The sheet manufacturing apparatus 100 also includes a sheet processing device 1000. The sheet processing device 1000 is described further below.

The supply device 10 supplies feedstock to the shredder 12. The supply device 10 may be a box into which recovered paper is loaded, or a tray or cassette storing recovered paper, and has the ability to sequentially pick and feed the stored recovered paper. The supply device 10 is, for example, an automatic loader for continuously supplying feedstock to the shredder 12. The feedstock supplied by the supply device 10 includes fiber from recovered paper or pulp sheets, for example.

The shredder 12 cuts feedstock supplied by the supply device 10 into shreds in air. The shreds in this example are pieces a few centimeters square. In the example in the figure, the shredder 12 has shredder blades 14, and can shred the supplied feedstock by the shredder blades 14. In this example, a paper shredder is used as the shredder 12. The feedstock shredded by the shredder 12 is received into a hopper 1 and carried (conveyed) to the defibrator 20 through a conduit 2.

The defibrator 20 defibrates the feedstock shredded by the shredder 12. Defibrate as used here is a process of separating feedstock (material to be defibrated) comprising many interlocked fibers into individual detangled fibers. The defibrator 20 also functions to separate particulate such as resin, ink, toner, and sizing agents in the feedstock from the fibers.

Material that has past through the defibrator 20 is referred to as defibrated material. In addition to untangled fibers, the defibrated material may also contain ink, toner, or other color materials. The shape of the detangled defibrated material is a string or ribbon. The detangled defibrated material may be separated from (not interlocked with) other detangled fibers, or may be in lumps interlocked with other detangled defibrated material (in so-called fiber clumps).

The defibrator 20 defibrates in a dry process. Processes including defibrating that are performed in ambient air (air) instead of a liquid are referred to herein as dry processes. In this embodiment, an impeller mill is used as the defibrator 20. The defibrator 20 also has the function of creating an air flow that sucks in the feedstock and then discharges the defibrated material. As a result, the defibrator 20 can suction the feedstock with the air flow from the inlet 22, defibrate, and then convey the defibrated material to the exit 24 using the air flow produced by the defibrator 20. The defibrated material that past the defibrator 20 is conveyed through a conduit 3 to the classifier 40. Note that the air stream conveying the defibrated material from the defibrator 20 to the classifier 40 may be the air current created by the defibrator 20, or a separate blower or other fan device may be used to create the air current.

The classifier 40 selects fibers by length from the defibrated material defibrated by the defibrator 20 that was introduced through an inlet 42. The classifier 40 includes a drum and a housing 43 that houses the drum 41. A sieve is used as the drum 41. The drum 41 has mesh (filter, screen), and can separate fiber or particles that are smaller than the size of the openings in the mesh (that pass through the mesh, first selected material) from fiber, undefibrated shreds, and clumps that are larger than the openings in the mesh (that do not pass through the mesh, second selected material). For example, the first selected material is conveyed through a conduit 7 to a mixing device 50. The second selected material is returned from an outlet 44 through a conduit 8 to the defibrator 20.

More specifically, the drum 41 of the classifier 40 is a cylinder driven rotationally by a motor. The mesh of the drum 41 may be a metal screen, expanded metal made by expanding a metal sheet with slits formed therein, or punched metal having holes formed by a press in a metal sheet, for example.

The first web forming device 45 conveys the first selected material from the classifier 40 to the mixing device 50. The first web forming device 45 includes, for example, a mesh belt 46, tension rollers 47, and a suction device (suction mechanism) 48.

The suction device 48 suctions the first selected material that past through the openings (mesh openings) in the classifier 40 and was dispersed in air onto the mesh belt 46. The first selected material accumulates on the moving mesh belt 46, forming a web V. The basic configuration of the mesh belt 46, tension rollers 47, and suction device 48 are the same as the mesh belt 72, tension rollers 74, and suction mechanism 76 of the second web forming device 70 described below.

The web V is a soft, fluffy web containing a lot of air as a result of passing through the classifier 40 and first web forming device 45. The web V deposited on the mesh belt 46 is fed into a conduit 7 and conveyed to the mixing device 50.

The rotor 49 can cut the web V before the web V is conveyed to the mixing device 50. In the example in the figure, the rotor 49 has a base 49*a*, and blades 49*b* protruding from the base 49*a*. The blades 49*b* in this example have a flat shape. In the example in the figure, there are four blades 49*b*, and the four blades 49*b* are equally spaced around the base 49*a*. By the base 49*a* turning in direction R, the blades 49*b* rotate on the axis of the base 49*a*. By cutting the web V with the rotor 49, variation in the amount of defibrated material per unit time supplied to the air-laying device 60, for example, can be reduced.

The rotor 49 is disposed near the first web forming device 45. In the example in the figure, the rotor 49 is disposed near a tension roller 47*a* (beside the tension roller 47*a*) located at the downstream side of the conveyance path of the web V. The rotor 49 is disposed at a position where the blades 49*b* can contact the web V but do not touch the mesh belt 46 on which the web V is laid. As a result, wear (damage) to the mesh belt 46 by the blades 49*b* can be suppressed. The minimum distance between the blades 49*b* and mesh belt 46 is preferably greater than or equal to 0.05 mm and less than or equal to 0.5 mm, for example, a distance enabling cutting the web V without the mesh belt 46 being damaged.

The mixing device 50 mixes an additive containing resin with the first selected material (the first selected material conveyed by the first web forming device 45) that past the classifier 40. The mixing device 50 has an additive supply device 52 that supplies additive, a conduit 54 for conveying the selected material and additive, and a blower 56. In the example in the figure, the additive is supplied from the additive supply device 52 through a hopper 9 to a conduit 54. Conduit 54 communicates with conduit 7.

The mixing device 50 uses the blower 56 to produce an air flow, and can convey while mixing the selected material and additives in the conduit 54. Note that the mechanism for mixing the first selected material and additive is not specifically limited, and may mix by means of blades turning at high speed, or may use rotation of the container like a V blender.

A screw feeder such as shown in FIG. 1, or a disc feeder not shown, for example, may be used as the additive supply device 52. The additive supplied from the additive supply device 52 contains resin (binder) for binding multiple fibers together. The multiple fibers are not bonded together at the time the resin is supplied. The resin melts and binds multiple fibers when passing the sheet forming device 80.

The resin supplied from the additive supply device 52 is a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination. The additive supplied from the additive supply device 52 may be fibrous or powder.

In addition to resin for binding fibers, and depending on the type of sheet being manufactured, the additive supplied from the additive supply device 52 may also include a coloring agent for coloring the fiber, an anti-blocking agent to prevent agglomeration of fibers and agglomeration of resin, or a flame retardant for making the fiber difficult to burn. The mixture (a mixture of first selected material and additive) that past the mixing device 50 is conveyed through a conduit 54 to the air-laying device 60.

The mixture that past the mixing device 50 is introduced from an inlet 62 to the air-laying device 60, and the air-laying device 60 detangles and disperses the tangled defibrated material (fiber) in air while the mixture precipitates. When the resin in the additive supplied from the additive supply device 52 is fibrous, the air-laying device 60 also detangles interlocked resin fibers. As a result, the air-laying device 60 can lay the mixture uniformly in the second web forming device 70.

The air-laying device 60 includes a drum 61 and a housing 63 that houses the drum 61. A sieve in the shape of a cylinder that turns is used as the drum 61. The drum 61 has mesh, and causes fiber and particles smaller than the size of the mesh (that pass through the mesh) and contained in the mixture that past the mixing device 50 to precipitate. The configuration of the drum 61 in this example is the same as the configuration of the drum 41 of the classifier 40.

Note that the sieve of the drum 61 may be configured without functionality for selecting specific material. More specifically, the sieve used as the drum 61 means a device having mesh, and the drum 61 may cause all of the mixture introduced to the drum 61 to precipitate.

The second web forming device 70 lays the precipitate that past through the air-laying device 60 into a web W. The web forming device 70 includes, for example, a mesh belt 72, tension rollers 74, and a suction mechanism 76.

The mesh belt 72 is moving while precipitate that has past through the holes (holes of the mesh) of the air-laying device 60 accumulates thereon. The mesh belt 72 is tensioned by the tension rollers 74, and is configured so that air passes through but it is difficult for the precipitate to pass through. The mesh belt 72 moves when the tension rollers 74 turn. A web W is formed on the mesh belt 72 as a result of the mixture that past the air-laying device 60 precipitating continuously while the mesh belt 72 moves continuously. The mesh belt 72 may be metal, plastic, cloth, or nonwoven cloth.

The suction mechanism 76 is disposed below the mesh belt 72 (on the opposite side as the air-laying device 60). The suction mechanism 76 produces a downward flow of air (air flow directed from the air-laying device 60 to the mesh belt 72). The mixture distributed in air by the air-laying device 60 can be pulled onto the mesh belt 72 by the suction mechanism 76. As a result, the discharge rate from the air-laying device 60 can be increased. A downward air flow can also be created in the descent path of the mixture, and interlocking of defibrated material and additive during descent can be prevented, by the suction mechanism 76.

A soft, fluffy web W containing much air is formed by material passing through the air-laying device 60 and second web forming device 70 (web forming process) as described above. The web W laid on the mesh belt 72 is then conveyed to the sheet forming device 80.

Note that a wetting device 78 for adjusting the moisture content of the web W is disposed in the example shown in the figure. The wetting device 78 adds water or water vapor to the web W to adjust the ratio of water to web W.

The sheet forming device 80 (forming unit) applies heat and pressure to the web W (deposited material) laid on the mesh belt 72, forming a sheet S. By applying heat to the mixture of defibrated material and additive mixed into the web W, the sheet forming device 80 can bind fibers in the mixture together through the additive (resin).

The sheet forming device 80 includes a compression device 82 that compresses the web W, and a heating device 84 that heats the web W after being compressed by the compression device 82. The compression device 82 in this example comprises a pair of calender rolls 85 that apply pressure to the web W. Calendering reduces the thickness of the web W and increases the density of the web W. A heat roller (heating roller), hot press molding machine, hot plate, hot air blower, infrared heater, or flash fuser, for example, may be used as the heating device 84. In the example in the figure, the heating device 84 comprises a pair of heat rollers 86. By configuring the heating device 84 with heat rollers 86, a sheet S can be formed while continuously conveying the web W, unlike when the heating device 84 is configured with a flat press (flat press machine). The calender rolls 85 (compression device 82) can apply greater pressure to the web W than the pressure that can be applied by the heat rollers 86 (heating device 84). Note that the number of calender rolls 85 and heat rollers 86 is not specifically limited.

The cutting device 90 cuts the sheet S formed by the sheet forming device 80. In the example in the figure, the cutting device 90 has a first cutter 92 that cuts the sheet S crosswise to the conveyance direction of the sheet S, and a second cutter 94 that cuts the sheet S parallel to the conveyance direction. In this example, the second cutter 94 cuts the sheet S after passing through the first cutter 92.

Cut sheets S of a specific size are formed by the process described above. The cut sheets S are then discharged to the discharge device 96.

The configuration of the sheet processing device is described next.

Figure 2:
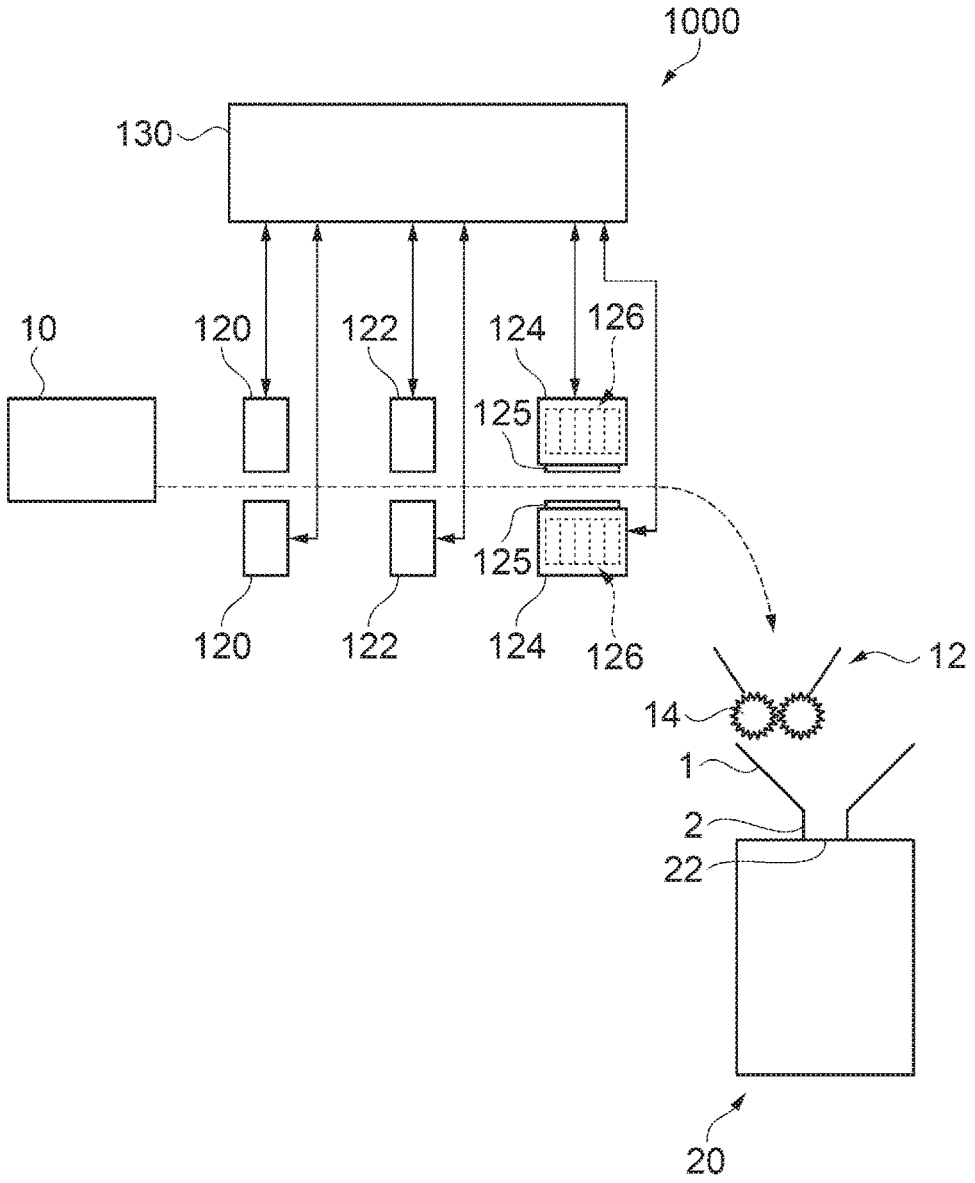
FIG. 2 schematically illustrates the configuration of sheet processing device according to the first embodiment of the invention.

FIG. 2 schematically illustrates the configuration of the sheet processing device.

As shown in FIG. 2, the sheet processing device 1000 has a scanner 120 as an image inspection means, and a color meter 122, an image analyzer 130, an inkjet printing device 124 as an ink masking agent applicator, and the shredder 12 and defibrator 20 as a milling means.

The scanner 120 has a line sensor and inspects image information read from single sheets (recovered paper) supplied by the supply device 10. More specifically, the scanner 120 reads the location, size, and shape of image information printed on a sheet (images the sheet). In this embodiment of the invention, to enable acquiring images of both sides of sheets supplied by the supply device 10 described above, there are two (a pair of) scanners 120 disposed to the conveyance path of the supplied sheet facing the opposite sides of the sheet. Each scanner is electrically connected to the image analyzer 130, and the image data captured by each scanner 120 is sent to the image analyzer 130.

Note that the image information means the printed information on the sheet, and may include combinations of text, symbols, graphics, patterns, and colors.

The color meter 122 reads the color information in the image information of the single sheets (recovered paper) supplied by the supply device 10. The color meter 122 is a measuring instrument known from the literature, and quantifies the color information as L*a*b* values, for example.

The color meter 122 in this example has a light source (such as LEDs) and a photodetector (such as photodiodes), and measures the reflection (glossiness) of the image information applied to (printed) the sheet. The reflectance is different when the color material printed on a sheet is water based (such as ink applied by common inkjet printers), and when the color material is a resin toner (charge control agent applied by an electrophotographic printer). As a result, the type of color material (water-based ink or resin toner) deposited on the sheet can be determined by measuring the reflectance of the images on the sheet.

To enabling acquiring images of both sides of a sheet supplied from the supply device 10, this embodiment of the invention has two color meters 122 disposed facing the opposite sides of the sheet on the conveyance path of the supplied sheet. Each color meter 122 is electrically connected to the image analyzer 130, and the color data captured by each color meter 122 is sent to the image analyzer 130.

Note that the color meters 122 are disposed on the downstream side of the scanners 120 in the conveyance direction of the sheet, but the invention is not so limited and the color meter 122 may be disposed on the upstream side of the scanners 120 in the conveyance direction of the sheet.

The image analyzer 130 is a control device, and includes a CPU, memory, and drivers. Note that these functions (see FIG. 1) may be provided by the controller 104 instead of the image analyzer 130.

The image analyzer 130 determines the type of ink masking agent and the amount of ink masking agent to use based on the information (including evaluation data) acquired by the scanner 120 and color meter 122.

More specifically, based on the location of the image information, size of the image, shape of the image, color of the image, and reflectance of the image acquired by the scanner 120 and color meter 122, the image analyzer 130 type of ink masking agent and the amount of ink masking agent to apply to the sheet.

The ink masking agent is material applied (added) to the image information on the supplied sheet to improve the whiteness (reduce blackening) of the newly manufactured sheet S.

The ink masking agent in this embodiment is ink. The ink may be water based, solvent, or oil based. This ink contains the pigment of the ink masking agent dispersed in solution.

The ink masking agent in this example is white ink More specifically, white ink is used regardless of the background color of the supplied sheet. The white ink may contain zinc oxide (ZnO), titanium oxide (titanium white) ($TiO_2$), alumina white ($Al_2O_3.nH_2O$), lithopone ($ZnS+BaSO_4$), gypsum ($CaSO_4.2H_2O$), barium sulfate ($BaSO_4$), calcium carbonate ($CaCO_3$), or white lead ($2PbCO_3.Pb$ (OH)2), for example.

The image analyzer 130 generates ink ejection data (print data) based on the acquired information (including evaluation data), and discharges the type of ink masking agent (white ink) and the amount of ink masking agent (white ink) determined according to the ink ejection data onto the sheet from the inkjet printing device 124 used as the ink masking agent applicator.

The inkjet printing device 124 includes an inkjet head 125, a moving mechanism (not shown in the figure) for moving the inkjet head 125, and ink storage 126 (such as an ink cartridge) that stores the ink (ink masking agent). This embodiment has an ink storage 126 storing a water-based ink (white ink), and an ink storage 126 storing a solvent (or oil) white ink. The inkjet head 125 has nozzles (not shown in the figure) for ejecting each kind of ink.

The inkjet printing device 124 applies the specific type and specific amount of ink masking agent (in this embodiment, white ink) determined by the image analyzer 130 over the color information previously printed on the sheet. More specifically, the inkjet printing device 124 ejects white ink at the location of the images printed on the sheet, and coats that image area with white ink. The specific area to which the white ink is applied is the area at least covering the image information, and may be discharged to cover individual characters, images, or marks (symbols), or to cover a solid block containing multiple characters, images, or marks.

The shredder 12 and defibrator 20 used as the milling means are as described above.

The sheets to which white ink was applied are supplied to the shredder 12 and defibrator 20, and shredded and defibrated. As a result, the image information formed on the sheet is erased.

By then supplying the defibrated material defibrated by the defibrator 20 to the classifier 40 and downstream in the manufacturing device 102, a whitened sheet S (with reduced blackening) can be made.

Note that because a scanner 120, color meter 122, and inkjet printing device 124 are disposed to each side of the supplied sheet in the configuration described above, image information and color information printed on each side can be acquired, and white ink can be applied to the locations of the images printed on each side of the sheet. As a result, the whiteness of sheets printed on both sides can be improved, White ink may also be applied to the same positions on the second side (back side) of the sheet as the printed areas on the first side (front side). In this case, image information and color information is acquired by the scanner 120 and color meter 122 disposed to the first side, and white ink is applied to the locations where images are printed on the first side by the inkjet printing device 124 disposed to print on the first side, and white ink is applied by the inkjet printing device 124 disposed to print on the second side, the opposite side as the first side, to the same locations on the second side as the images printed on the first side.

Whiteness can be further improved in this way because the printed areas where image information was applied can be covered with white ink from both sides of the sheet.

The sheet processing method of the sheet processing device 1000 is described next.

Figure 3:
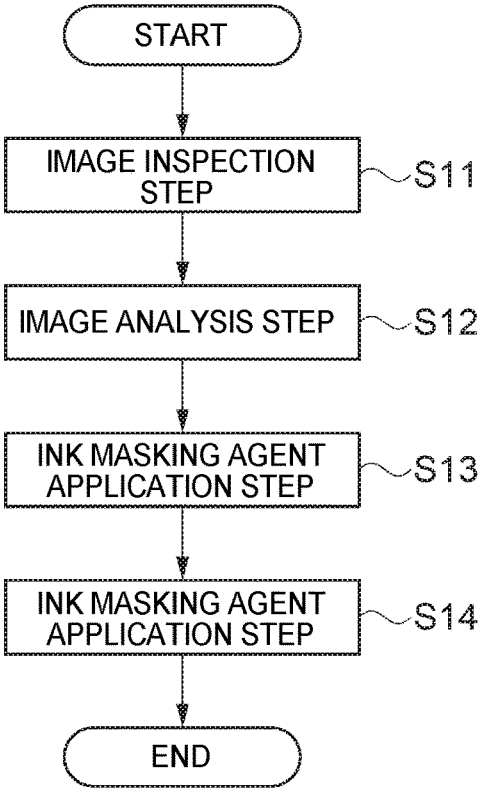
FIG. 3 is a flow chart of the sheet processing method of the sheet processing device according to the first embodiment of the invention.
Figure 4:
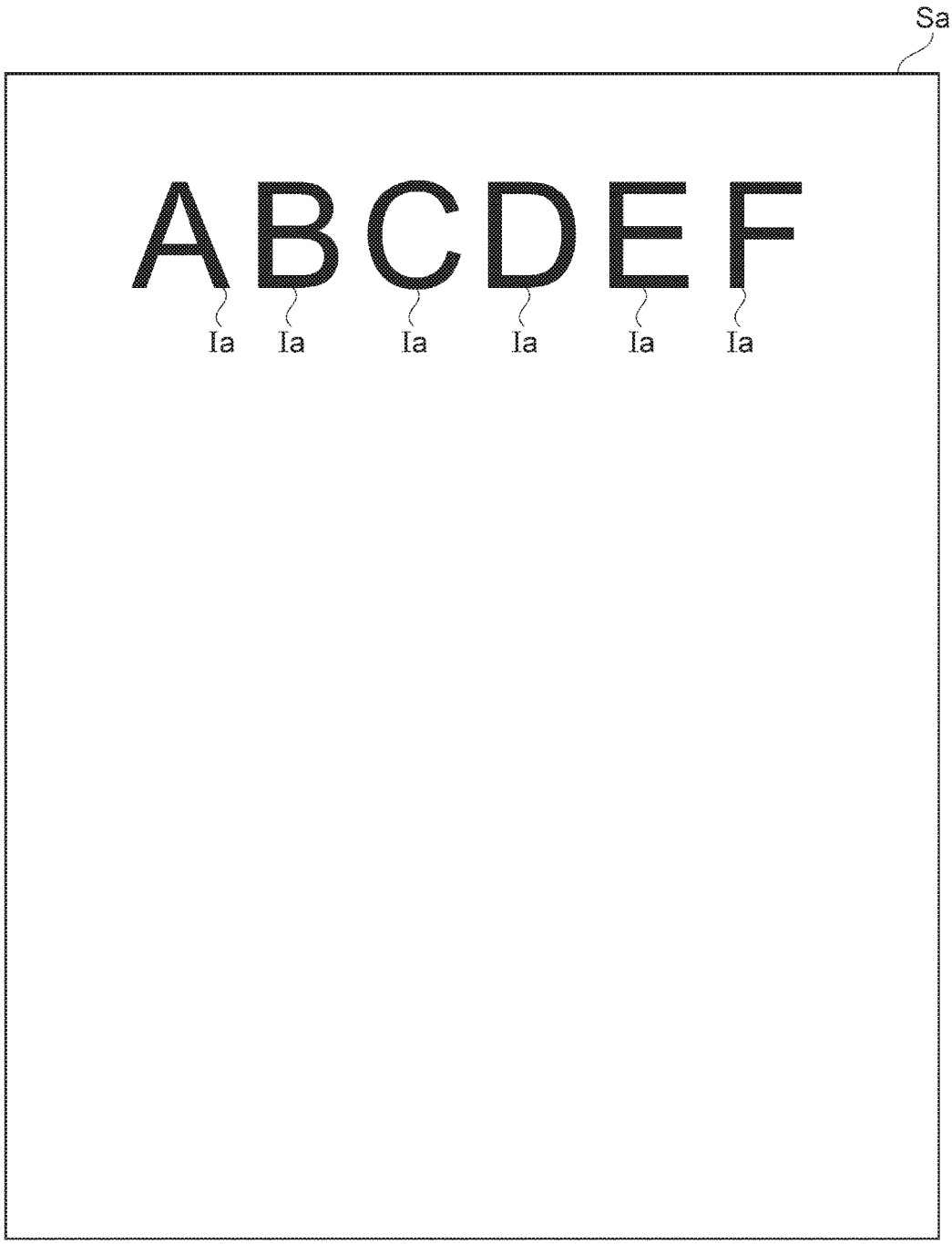
FIG. 4 is a flow chart of the sheet processing method of the sheet processing device according to the first embodiment of the invention.
Figure 6:
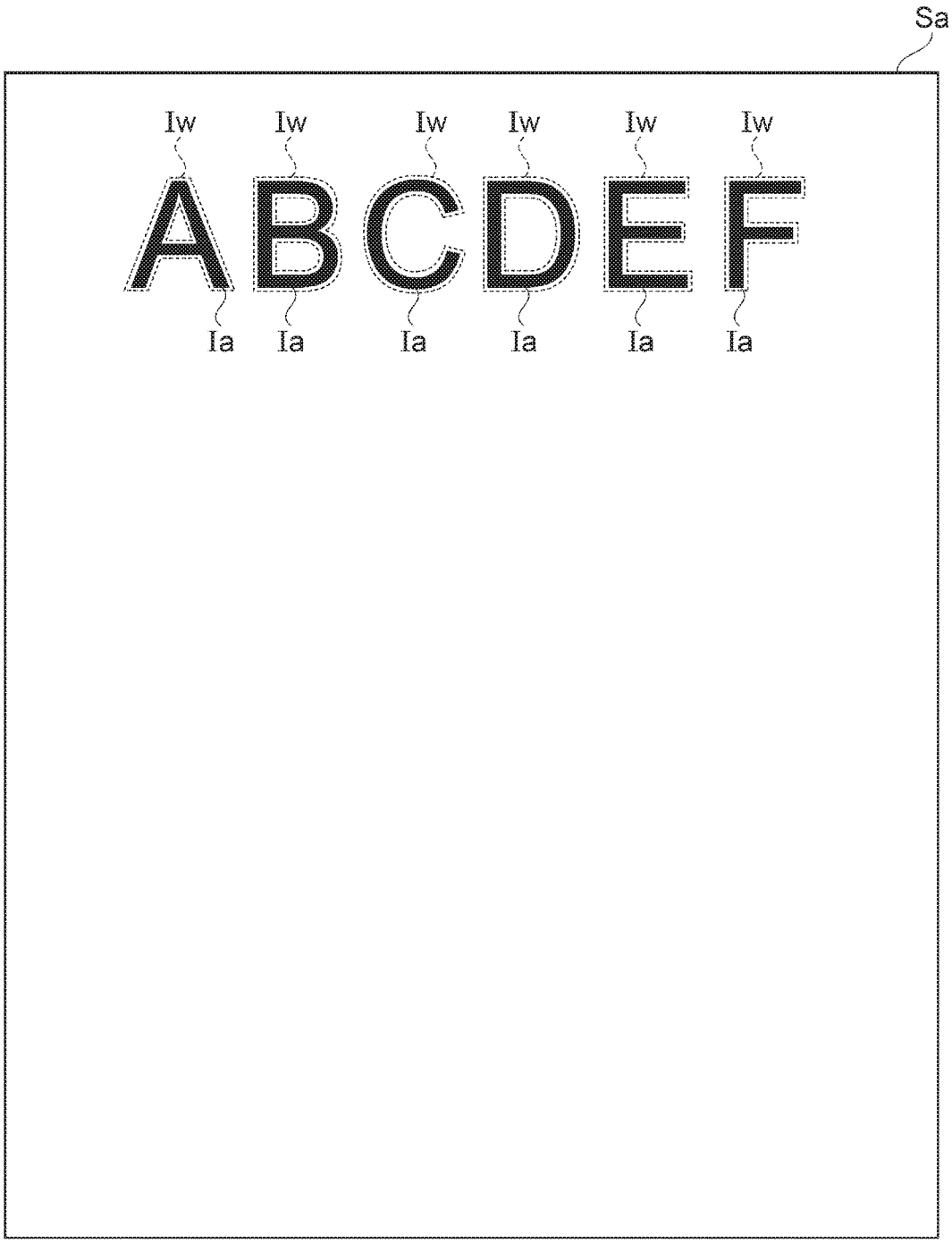
FIG. 6 is a flow chart of the sheet processing method of the sheet processing device according to the first embodiment of the invention.
Figure 7A:
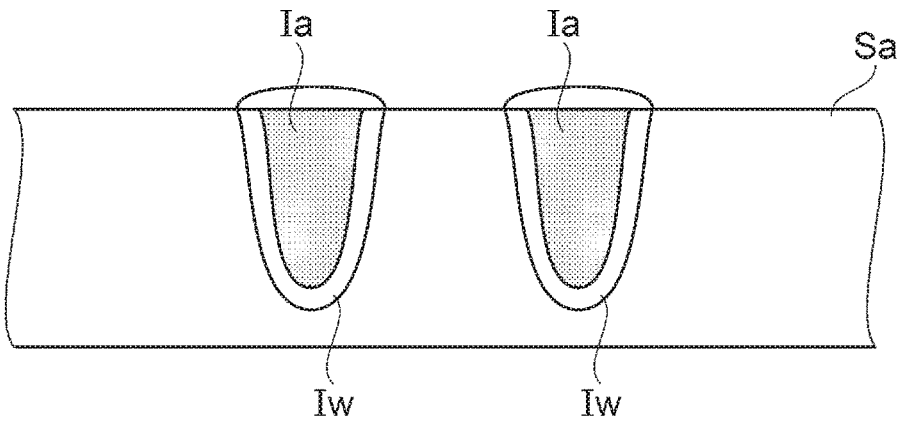
FIG. 7A is a flow chart of the sheet processing method of the sheet processing device according to the first embodiment of the invention.
Figure 7B:
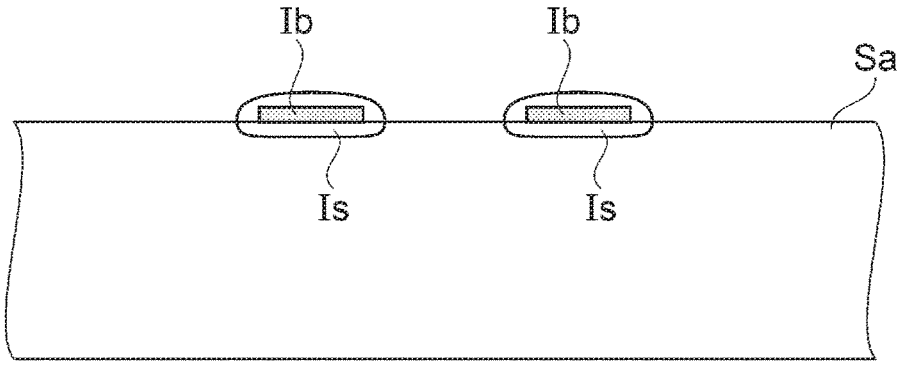
FIG. 7B is a flow chart of the sheet processing method of the sheet processing device according to the first embodiment of the invention.
Figure 8A:
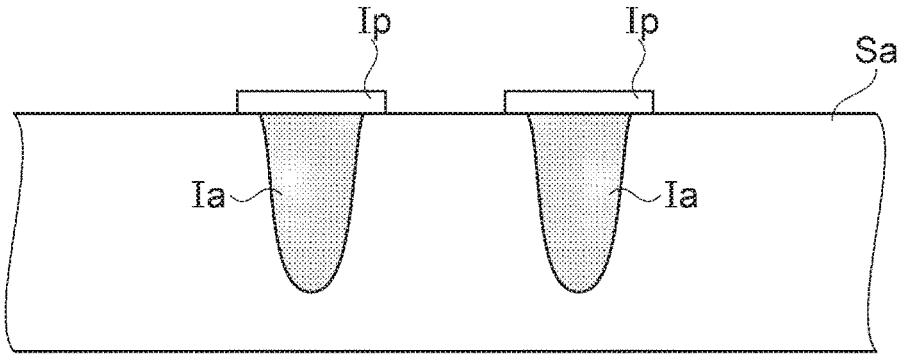
FIG. 8A describes an example for comparison.
Figure 8B:
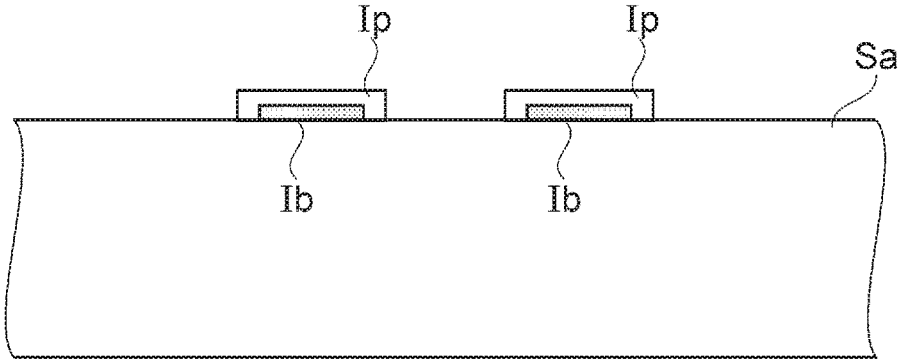
FIG. 8B describes an example for comparison.

FIG. 3 is a flow chart of the sheet processing method of the sheet processing device according to this embodiment of the invention. FIG. 4 to FIG. 6 illustrate the sheet processing method. FIG. 7A and FIG. 7B schematically describe the sheet processing method of the sheet processing device, and FIG. 8A and FIG. 8B show other examples for comparison.

In the image inspection step (S11) the scanner 120 and color meter 122 inspect the image information of the sheet supplied from the supply device 10.

More specifically, the scanner 120 and color meter 122 are driven, the image information printed on the sheet Sa discharged from the supply device 10 (the letters ABCDEF in the example in FIG. 4) is examined to determine the location, size, and shape of the images, and the color and reflectance of the image information. The resulting data is then sent to the image analyzer 130.

In the image analysis step (S12), the image analyzer 130 determines the type of ink masking agent and the amount of ink masking agent based on the inspection data acquired by the scanner 120 and color meter 122.

More specifically, the image analyzer 130 determines the color material of the image on the sheet Sa from the detected reflectance. The image analyzer 130 determines that a water based ink was used if the reflectance (or glossiness) is less than a specific value, and decides a resin toner was used if the reflectance (or glossiness) is greater than a specific value.

As shown in FIG. 5, if the image information is identified as a water based ink, a water based ink is selected as the type of ink masking agent. However, if the image information is determined to be a resin toner, a solvent ink (or oil based ink) is selected as the type of ink masking agent.

The amount of ink masking agent is stored relationally to the size of the image information in a data table, and the amount of ink masking agent to apply is determined (selected) from the result of analyzing the size of the image information. Note that when the image information is large, the amount of ink masking agent is greater than when there is little image information. In other words, when the printed area is large, the amount of ink masking agent is greater than when the printed area is small.

In this embodiment of the invention the color of the ink applied as the ink masking agent is white ink. More specifically, white ink is applied regardless of the background color of the supplied sheet Sa.

In the image analysis step (S12), ink ejection data (print data) is generated based on the acquired image information, and the ink ejection data is sent to the inkjet printing device 124.

Next, in the ink masking agent application step (S13), ink masking agent of the specific type and specific amount determined in the image analysis step (S12) is applied over the image information on the sheet Sa.

More specifically, as shown in FIG. 6, the inkjet printing device 124 is driven to apply the ink masking agent (white ink) of the specific type (water based or solvent ink (oil based ink)) and specific amount over the image information on the sheet Sa. As a result, the applied white ink penetrates the surface and area surrounding the image information (printed parts).

FIG. 7A shows the part of the sheet Sa in section view when image information printed with a water based ink Ia as the image information on the sheet Sa is covered with a water based ink Iw (white ink) as the ink masking agent.

As shown in FIG. 7A, the water based ink Iw printed onto the sheet Sa penetrates into the thickness of the sheet Sa. When water based ink Iw (white ink) is applied over the water based ink Ia printed on the sheet Sa in the ink masking agent application step (S13), the water based ink Iw (white ink) penetrates the area around the water based ink Ia as seen in section view. In other words, the water based ink Iw can penetrate deep into the surface of the sheet Sa and cover the water based ink Ia.

FIG. 7B shows the part of the sheet Sa in section view when image information printed with a resin toner Ib as the image information on the sheet Sa is covered with a solvent ink (oil based ink) Is as the ink masking agent.

As shown in FIG. 7B, the resin toner Ib printed on the sheet Sa is fused to the surface of the sheet Sa. When solvent ink (oil based ink) Is is applied over the resin toner Ib printed on the sheet Sa in the ink masking agent application step (S13), the solvent ink (oil based ink) Is penetrates the area around the resin toner Ib as seen in section view. In other words, the exposed surface of the resin toner Ib is covered, and much of the back of the resin toner Ib on surface of the sheet Sa can be covered by solvent ink (oil based ink) Is.

In this way, the applied white ink penetrates and surrounds the printed portion in both FIG. 7A and FIG. 7B.

FIG. 8A and FIG. 8B show another example for comparison with FIG. 7A and FIG. 7B.

More specifically, FIG. 8A shows the part of the sheet Sa in section view when image information printed with a water based ink Ia as the image information on the sheet Sa is fused with a powder charge control agent (white resin toner) Ip by an electrophotographic method as the ink masking agent.

FIG. 8B shows the part of the sheet Sa in section view when image information printed with a resin toner Ib as the image information on the sheet Sa is fused with a powder charge control agent (white resin toner) Ip by an electrophotographic method as the ink masking agent.

Note that the charge control agent may be polyester, polyethylene, polypropylene, or polystyrene, for example.

As shown in FIG. 8A, water based ink Ia printed as the image information on the sheet Sa penetrates the thickness of the sheet Sa, but when a charge control agent (white resin toner) Ip is fused to the image information printed with water based ink Ia, the resin toner Ip does not penetrate the sheet Sa and instead only covers the surface of the water based ink Ia.

Therefore, compared with the case shown in FIG. 7A, the amount of white resin toner Ip is significantly less than the amount of water based ink Ia printed as the image information in the example shown in FIG. 8A.

In addition, as shown in FIG. 8B, resin toner Ib printed as the image information is fused to the surface of the sheet Sa. When charge control agent (white resin toner) Ip is fused to the image information printed with resin toner Ib, the resin toner Ip does not penetrate the sheet Sa and instead only covers the surface of the resin toner Ib.

Therefore, compared with the case shown in FIG. 7B, the amount of white resin toner Ip is significantly less than the amount of resin toner Ib printed as the image information in the example shown in FIG. 8B.

As will be understood from the above comparison, because the amount of ink masking agent relative to the image information is greater when selecting the ink masking agent appropriate to the image information and applying the selected ink masking agent as shown in FIG. 7A and FIG. 7B, whiteness can be improved with the sheet Sa to which ink masking agent was applied is shredded. In other words, blackening can be reduced.

As shown in FIG. 7A and FIG. 7B, because the image information is covered by an ink masking agent (white ink), reading the image information is made more difficult and confidentiality (security) can be improved.

Next, in the shredding step (S14), the sheet Sa to which ink masking agent (white ink) was applied in the ink masking agent application step (S13) is shredded.

More specifically, the sheet Sa printed with white ink is fed into the shredder 12 (see FIG. 2). The sheet Sa supplied to the shredder 12 is then shredded into pieces a few centimeters square. Next, the shreds are fed into the defibrator 20 (see FIG. 2). As a result, the shreds are defibrated.

As a result, the image information on the sheet Sa is completely erased in the shredding step (S14), and whitened defibrated material is formed.

The sheet processing method of the sheet processing device 1000 is described above, but when manufacturing a sheet S using the defibrated material produced in the shredding step (S14), the defibrated material is supplied in the sheet manufacturing apparatus 100 to the manufacturing device 102 downstream from the classifier 40. As a result, a whitened (reduced blackening) sheet S can be manufactured.

Effects of this embodiment are described below.

Based on the inspection results of images on a sheet Sa by the scanner 120 and color meter 122, an ink masking agent (white ink) of the type and amount appropriate to the image information is applied to the image information (printed areas). The sheet Sa printed with ink masking agent (white ink) is then shredded and defibrated by the defibrator 20. As a result, image information on a sheet can be completely erased without requiring large scale equipment, and whiteness can be imparted to the newly manufactured sheet.

Embodiment 2

A second embodiment of the invention is described next.

The sheet processing device 1000 according to the first embodiment of the invention applies white ink (ink masking agent) regardless of the background color of the sheet Sa bearing image information. This embodiment of the invention applies ink (ink masking agent) of a color corresponding to the background color of the sheet Sa bearing image information.

Figure 9:
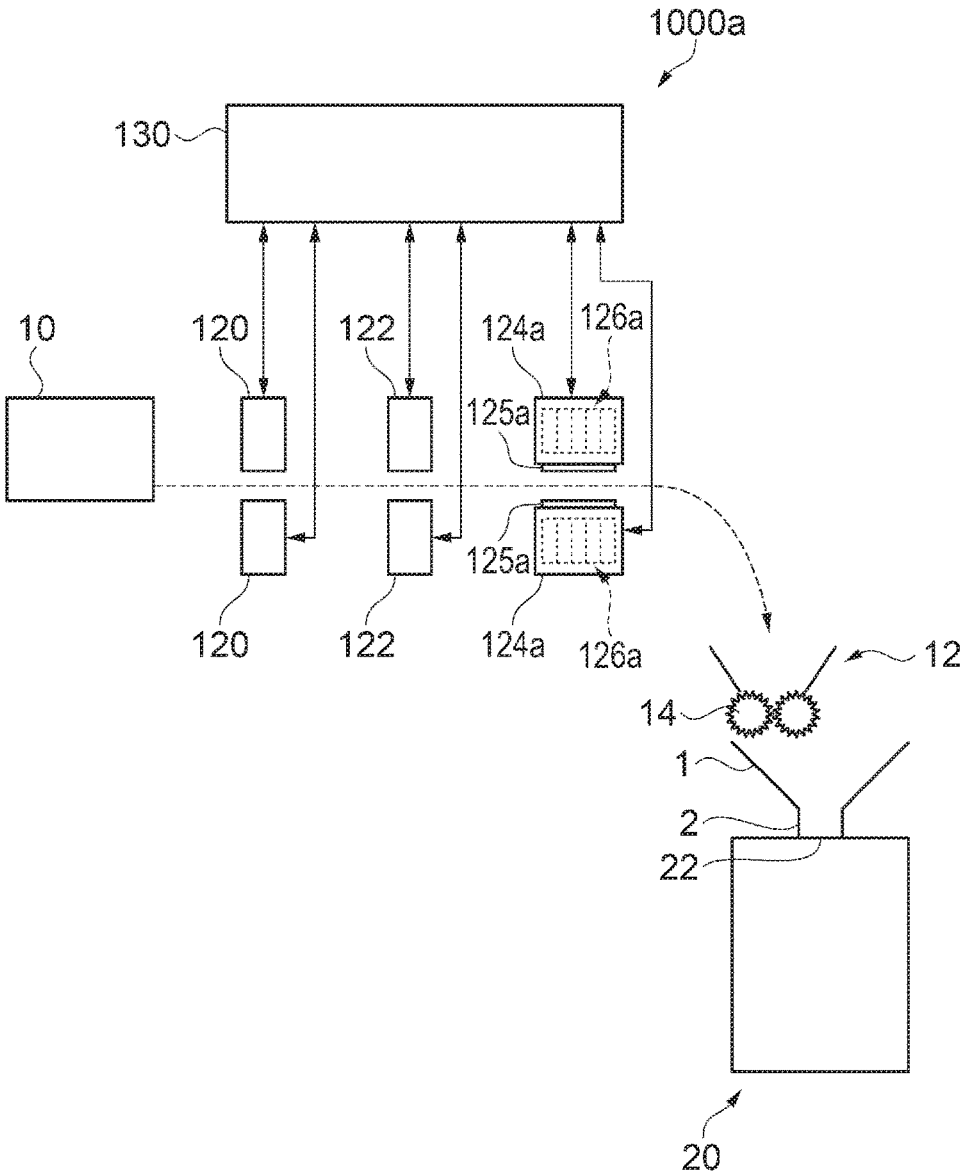
FIG. 9 schematically illustrates the configuration of sheet processing device according to a second embodiment of the invention.

FIG. 9 schematically illustrates the configuration of the sheet processing device according to this embodiment.

As shown in FIG. 9, the sheet processing device 1000*a* has a scanner 120 as an image inspection means, and a color meter 122, an image analyzer 130, an inkjet printing device 124*a* as an ink masking agent applicator, and the shredder 12 and defibrator 20 as a milling means.

Note that the scanner 120, color meter 122, image analyzer 130, shredder 12, and defibrator 20 are the same as in the first embodiment, and further description thereof is omitted.

The inkjet printing device 124*a* includes an inkjet head 125*a*, a moving mechanism (not shown in the figure) for moving the inkjet head 125*a*, and ink storage 126*a* (such as an ink cartridge) that stores the ink (ink masking agent).

This embodiment of the invention has ink storage 126*a* holding water based inks including white (W), cyan (C), magenta (M), yellow (Y), and black (Bk); and a ink storage 126*a* storing solvent ink (or oil based ink) including white (W), cyan (C), magenta (M), yellow (Y), and black (Bk). The inkjet head 125*a* has nozzles (not shown in the figure) for ejecting each kind of ink.

The inkjet printing device 124*a* applies the specific type and specific amount of ink masking agent (in this embodiment, white ink) determined by the image analyzer 130 over the color information previously printed on the sheet. More specifically, the inkjet printing device 124*a* ejects the specified ink at the location of the images printed on the sheet, and coats that image area with the specified ink.

The image analyzer 130 first determines the type of ink masking agent and the amount of ink masking agent based on the inspection data acquired by the scanner 120 and color meter 122.

More specifically, the background color of the sheet Sa is measured by the color meter 122, and based on the result, the image analyzer 130 selects the appropriate inks from among the plural ink storages 126*a* to produce the same color as the background color of the sheet Sa. For example, if the sheet Sa is determined to be yellow, the image analyzer 130 selects yellow (Y).

The image analyzer 130 also determines the color material of the image on the sheet Sa from the detected reflectance. The image analyzer 130 determines that a water based ink was used if the reflectance (or glossiness) is less than a specific value, and decides a resin toner was used if the reflectance (or glossiness) is greater than a specific value. If the image information is identified as being printed with a water based ink, a water based ink is selected as the type of ink masking agent. However, if the image information is determined to be a resin toner, a solvent ink (or oil based ink) is selected as the type of ink masking agent (see FIG. 5).

The amount of ink masking agent is stored relationally to the size of the image information in a data table, and the amount of ink masking agent to apply is determined (selected) from the result of analyzing the size of the image information.

The inkjet printing device 124*a* is then driven to apply ink masking agent of the specific color, the specific type (water based or solvent ink (oil based ink)) and specific amount over the image information on the sheet Sa. As a result, the applied white ink penetrates the surface and area surrounding the image information (printed parts).

Penetration into the sheet Sa of the ink applied to the sheet Sa is the same as in the first embodiment (see FIG. 7A and FIG. 7B).

The sheets to which ink was applied are then supplied to the shredder 12 and defibrator 20, and shredded and defibrated. As a result, the image information formed on the sheet is erased, and defibrated material with reduced blackening is produced. By then supplying the defibrated material defibrated by the defibrator 20 to the classifier 40 and downstream in the manufacturing device 102, a sheet S with reduced blackening can be made.

Effects of this embodiment are described below.

The sheet processing device 1000*a* according to this embodiment applies ink of a color matching the background color of the sheet Sa bearing image information, and then shreds and defibrates the sheet Sa.

As a result, the image information on the sheet can be erased. Blackening of the newly manufactured sheet S is also reduced, and a sheet S of the same color as the background color of the sheet Sa can be produced.

The present invention is not limited to the foregoing embodiment, and the foregoing embodiment can be modified and improved in many ways. Examples of some variations are described below.

Variation 1:

The embodiments described above apply an ink masking agent (ink) of specific type and specific amount to a sheet Sa on which image information was printed. The sheet Sa printed with ink masking agent (ink) is then defibrated, and the defibrated material is used to produce a new sheet S (recycled sheet). When a new sheet S is made, the color of the new sheet S and the color of the original sheet are preferably the same.

This can be achieved by controlling driving the sheet processing device 1000 (sheet processing device 1000*a*) and sheet manufacturing apparatus 100 so that the color of the new sheet S is the same color as the original sheet Sa.

More specifically, the image analyzer 130 stores a data table correlating the type of ink masking agent and the amount of ink masking agent to the background color of the sheet Sa printed with image information, the color of the image information, and the size of the color information. Note that the standard for determining if the color of the new sheet S and the color of original sheet Sa are the same is a color difference ΔE of 5% or less. Because this is a level that is indiscernible to the eye, the color of the new sheet S and the color of original sheet Sa can be considered the same. In addition, the amount of ink masking agent set in the data table can be derived from the results of previous tests or evaluations, for example.

The sheet Sa printed with image information is then inspected by the scanner 120 and color meter 122, the appropriate type of ink masking agent and amount of ink masking agent are determined from the data table, and the selected ink masking agent (ink) is then applied to the sheet Sa.

As a result, a new sheet S with the same color as the color of the original sheet Sa can be produced.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-166555, filed Aug. 31, 2017 is expressly incorporated by reference herein.

What is claimed is:

1. A sheet processing device comprising:

an image inspector configured to determine from a sheet printed with image information at least one of a background color of the sheet, and position, size, and color of the image information on the sheet;

an image analyzer configured to determine, based on the evaluation result from the image inspector, a type of ink masking agent and an amount of ink masking agent;

an ink masking agent applicator configured to apply to the image information printed on the sheet an ink masking agent of the specific type and specific amount determined by the image analyzer; and a shredder configured to comminute the sheet to which the ink masking agent was applied by the ink masking agent applicator.

2. The sheet processing device described in claim 1, wherein:

the ink masking agent is ink.

3. The sheet processing device described in claim 2, wherein:

the ink is white ink.

4. A sheet manufacturing apparatus comprising the sheet processing device described in claim 1.

* * * * *